United States Patent [19]

Morita

[11] 4,386,511

[45] Jun. 7, 1983

[54] METHOD AND SYSTEM FOR CONTROLLING A PLATE WIDTH

[75] Inventor: Shinichi Morita, Fussa, Japan

[73] Assignee: Tokyo Shibaura Denki Kabushiki Kaisha, Kanagawa, Japan

[21] Appl. No.: 263,597

[22] Filed: May 14, 1981

[30] Foreign Application Priority Data

May 29, 1980 [JP] Japan ..... 55-71732

[51] Int. Cl.[3] ..... B21B 37/02

[52] U.S. Cl. ..... 72/121; 72/16; 72/366

[58] Field of Search ..... 72/12, 16, 366; 364/472

[56] References Cited

U.S. PATENT DOCUMENTS 4,294,094 10/1981 Okado et al. ..... 72/16

FOREIGN PATENT DOCUMENTS 50-90560 7/1975 Japan .

50-24907 8/1975 Japan ..... 72/16

56-41007 4/1981 Japan ..... 72/12

*Primary Examiner*—Francis S. Husar

*Assistant Examiner*—Jonathan L. Scherer

*Attorney, Agent, or Firm*—Stevens, Davis, Miller & Mosher

[57] ABSTRACT

In a method and a system for controlling a plate width in a hot rolling mill having a front stage including a horizontal roll stand; and a rear stage including a vertical roll stand and a horizontal roll stand, the thickness of a thickened portion of the plate thickened as a result of rolling by the vertical roll stand of the rear stage and the plate thickness at the entrance of the vertical roll stand of the rear stage are determined; the ratio of the thickness of the thickened portion to the plate thickness at the entrance of the rear stage is calculated; the plate width at the exit of the vertical roll stand is determined; the plate width at the exit of the horizontal roll stand of the rear stage is calculated taking account of extension of the plate width as a result of reduction of the thickened portion; and the roll gap of the vertical roll stand of the rear stage is controlled in such a manner as to bring the plate width at the exit of the horizontal roll stand of the rear stage closer to a target value.

13 Claims, 8 Drawing Figures

METHOD AND SYSTEM FOR CONTROLLING A PLATE WIDTH

BACKGROUND OF THE INVENTION

The present invention relates to a method and a system for controlling a plate width in a hot rolling mill, particularly in a rolling mill for use with continuous casting.

In a conventional method for forming pig iron into intermediate products, such as slabs, blooms, or the like, molten steel taken out of a converter is poured into a mold and is subjected to natural cooling and the cast steel is heated in an annealing furnace and subsequently rolled by a blooming mill. Recently, the continuous casting which is advantageous over the above-mentioned conventional technique in energy saving, yield, etc., has been put into commercial application. In the continuous casting, molten steel travels through a water-cooled mold and a cooling zone. The molten steel is thus force-cooled and continuously solidifies into plates. In comparison with the first-mentioned method, the continuous casting has the drawback in that the width of the slab cannot be readily changed for the following reason. Where a material is rolled into a plate of a much smaller width and a plate of a dimension suitable according to the rolling schedule is to be obtained, replacement of a mold is required. But the replacement necessitates halting the continuous casting machine. This will considerably deteriorate productivity.

The drawback can be removed by having a roughing mill or blooming mill directly connected to a continuous casting machine and having the vertical roll gap adjustable over a certain range to permit plate width change. With this arrangement, it is possible to make the best use of the advantages of the continuous casting and to reduce the time of halting of the mill.

Various plate width controlling methods and systems based on the above-mentioned concepts have been proposed. One of the proposed methods is a method in which the vertical roll gap distance is controlled taking account of the forecasted width extension.

Where a plate is subjected to width reduction rolling by a vertical roll stand of a roughing mill and is reduced to a desired thickness by a horizontal roll stand of a roughing mill, the cross section of a plate after rolling by the vertical roll stand has projecting or thickened portions at width-wise ends. The cross section is called a dog bone section. The dimension of the elevated or thickened portions varies in the lengthwise direction. When the plate with the dog bone section is reduced by the horizontal roll stand of the roughing mill, the width of the plate is recovered or extended. The amount of the width extension varies in the lengthwise direction. In none of the conventional controlling methods and devices, exact relationship between the dimension of the thickened portions and the amount of the width extension due to flattening of the thickened portions is taken into consideration, and accuracy in the width of the resultant plate is not sufficient.

There is a rolling method of reducing a plate widthwise by a pair of grooved vertical rolls. In this method the fact that the vertical reduction produces thickened portions and the horizontal reduction generates width extension is not taken into consideration, so that a sufficient width accuracy is not attained.

SUMMARY OF THE INVENTION

An object of the present invention is to improve accuracy in the width of the plate after rolling.

Another object of the present invention is to provide a plate width controlling method and system for use in a hot rolling mill that can improve the yield of materials and rolling efficiency.

A further object of the invention is to improve efficiency of the rolling operation.

According to one aspect of the invention, there is provided a method for controlling a plate width in a hot rolling mill having a front stage including a horizontal roll stand; and a rear stage following said front stage and including a vertical roll stand and a horizontal roll stand, the method comprising the steps of: determining the thickness of a thickened portion of the plate thickened as a result of rolling by the vertical roll stand of the rear stage and the plate thickness at the entrance of the vertical roll stand of the rear stage; calculating the ratio of the thickness of the thickened portion to the plate thickness at the entrance of the rear stage; determining the plate width at the exit of the vertical roll stand; calculating, taking account of extension of the plate width as a result of reduction of the thickened portion, the plate width at the exit of the horizontal roll stand of the rear stage; and controlling the roll gap of the vertical roll stand of the rear stage in such a manner as to bring the plate width at the exit of the horizontal roll stand of the rear stage closer to a target value.

According to another aspect of the invention, there is provided a plate width control system for a hot rolling mill having a front stage including a horizontal roll stand and a rear stage following the front stage and including a vertical roll stand and a horizontal roll stand, comprising thickened portion thickness determining means for determining the thickness of a thickened portion of a plate thickened as a result of rolling by the vertical roll stand of the rear stage; thickness determining means for determining the plate thickness at the entrance of the vertical roll stand of the rear stage; ratio determining means for determining the ratio of the thickness of the thickened portion to the plate thickness at the entrance of the vertical roll stand based on the output from said thickened portion thickness determining means and the output from said thickness determining means; first width determining means for determining the plate width at the exit of the vertical roll stand of the rear stage; second width determining means for determining the plate width at the exit of the horizontal roll stand of the rear stage based on the output from said ratio determining means and the output from said first width determining means; roll gap controlling means for calculating the deviation of the plate width at the exit of the horizontal roll stand of the rear stage based on the output from said second width determining means and a target value; and controlling the roll gap of the vertical roll stand of the rear stage in such a manner as to make the deviation smaller.

DESCRIPTION OF PREFERRED EMBODIMENTS

Figure 1:
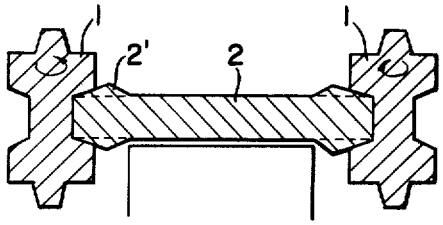
FIG. 1 is a sectional view showing a plate being reduced widthwise by a pair of grooved vertical rolls.

An embodiment of the invention which will be described is for use with a rear stage including a vertical roll stand including a pair of grooved vertical rolls 1, shown in FIG. 1. The vertical roll stand is used for widthwise reduction of a plate 2 to form a plate of a dog bone cross section with thickened portions.

Figure 2:
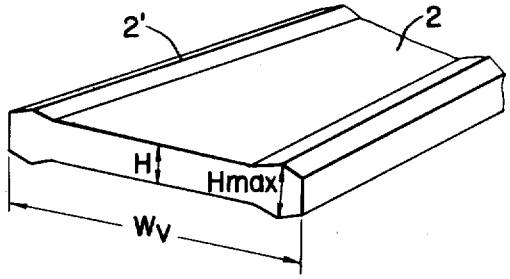
FIG. 2 is a perspective view showing a plate with thickened portions, the plate being obtained at the exit of a vertical roll stand.

FIG. 2 shows a plate 2 reduced widthwise by the vertical roll stand of the rear stage. The plate 2 has thickened portions 2' and has a dog bone cross section. As shown in FIG. 2, the width of the plate 2 at the exit of the vertical roll stand is represented by $W_v$; the plate thickness H; and the thickness $H_{max}$ of the thickened portions 2'.

Figure 3:
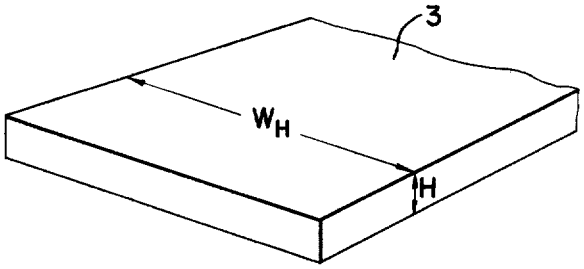
FIG. 3 is a perspective view showing a plate obtained at the exit of a horizontal roll stand.

FIG. 3 illustrates the plate 3 at the exit of a horizontal roll stand following the vertical roll stand of the rear stage. When the plate 2 as shown in FIG. 2 is reduced by the horizontal roll stand of the rear stage it is extended widthwise because of flattening of the thickened portions 2' and concurrently extended lengthwise, i.e., backward and forward, as shown in FIG. 3. The width of the plate 3 at the exit of the horizontal roll stand of the rear stage is represented by $W_H$; and the thickness thereof H.

The plate width at the exit of the vertical roll stand of the rear stage and the plate width at the exit of the horizontal roll stand of the rear stage bear a certain relationship with respect to the ratio of the thickness of the thickened portions to the plate thickness at the exit of the front stage. The relationship is known from the experimental data and is shown in FIG. 4.

Figure 4:
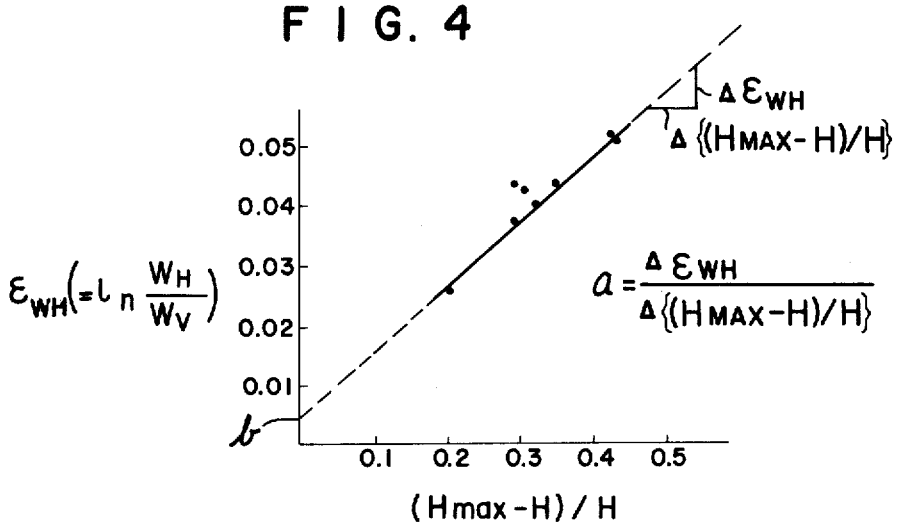
FIG. 4 is a graph showing a relationship between a ratio $^{\epsilon}W_H$ of the plate width extension and ratio $(H_{max}-H)/H$ of the thickness of the thickened portion.

In FIG. 4, the ordinate is natural logarithm $^{\epsilon}W_H$ of the ratio of the plate width $W_H$ at the exit of the horizontal roll stand of the rear stage to the plate width $W_v$ at the exit of the vertical roll stand of the rear stage. The abscissa is the ratio $(H_{max}-H)/H$ calculated based on the thickness $H_{max}$ of the thickened portions and the plate thickness H at the exit of the horizontal roll stand of the front stage. As is apparent from FIG. 4, the relationship between $^{\epsilon}W_H=\ln(W_H/W_v)$ and $(H_{max}-H)/H$ is linear. When the inclination is represented by a; the intercept of the ordinate b; and the ratio of the thickness of the thickened portions $(x=(H_{max}-H)/H)$, the relationship is expressed by the following equation:

$$ln(W_H/W_v)=ax+b \quad (1)$$

The equation (1) can be transformed into the following equation:

$$W_H=W_v\exp(ax+b) \quad (2)$$

The plate width at the exit of the horizontal roll stand of the rear stage can be calculated using the equation (2) when the plate width $W_v$ at the exit of the vertical roll stand of the rear stage and the thickness $H_{max}$ of the thickened portions and the thickness H of the plate at the exit of the horizontal roll stand of the front stage are known.

The plate width at the exit of the horizontal roll stand of the rear stage can be calculated using the equation (2) when the plate width $W_v$ at the exit of the vertical roll stand of the rear stage and the thickness $H_{max}$ of the thickened portions and the thickness H of the plate at the exit of the horizontal roll stand of the front stage are known.

The plate width $W_v$ at the exit of the vertical roll stand of the rear stage is determined by a plate width detecting device or the like, and the thickness $H_{max}$ of the thickened portions is determined by a combination of a thickened portion thickness detecting device and a thickened portion thickness measuring device.

The plate thickness H at the exit of the final roll stand of the front stage can be obtained in any one of various ways. In one of them, the following equation is utilized.

$$H=S+P/M \quad (3)$$

In the equation (3), S represents the horizontal roll gap; P the rolling load of the horizontal roll stand; and M the mill constant of the horizontal roll stand. An actual horizontal roll gap is available at the output of a roll gap controlling device which is in many cases provided for the horizontal roll stand, and the actual horizontal roll gap can be used for the required value S. The rolling load P is determined by a load determining device. The mill constant M is given. The plate thickness H at the exit of the final roll stand of the front stage is calculated from the above-mentioned values, in accordance with the equation (3).

It is then possible to calculate the plate width $W_H$ at the exit of the horizontal roll stand of the rear stage from the values obtained in accordance with the equation (2). Therefore, the deviation $\Delta W_H$ of the plate width $W_H$ at the exit of the horizontal roll stand of the rear stage from the target plate width $W_{Ho}$ is obtained by:

$$\Delta W_H=W_H-W_{Ho} \quad (4)$$

The vertical roll gap of the rear stage is controlled in such a manner as to make the deviation $\Delta W_H$ smaller.

Thus, the plate width at the exit of the horizontal roll stand of the rear stage is forecasted and is utilized as a factor for control over the vertical roll gap of the rear stage, so that the resultant plate width is maintained close to the target value.

The constants a and b in FIG. 4 may vary depending on the kind of steels, and are affected to some extent by the temperature of the material, the diameter of the roll, etc. It falls within the scope of the present invention to provide the optimum value through learning control in determining the constants a and b.

Figure 5:
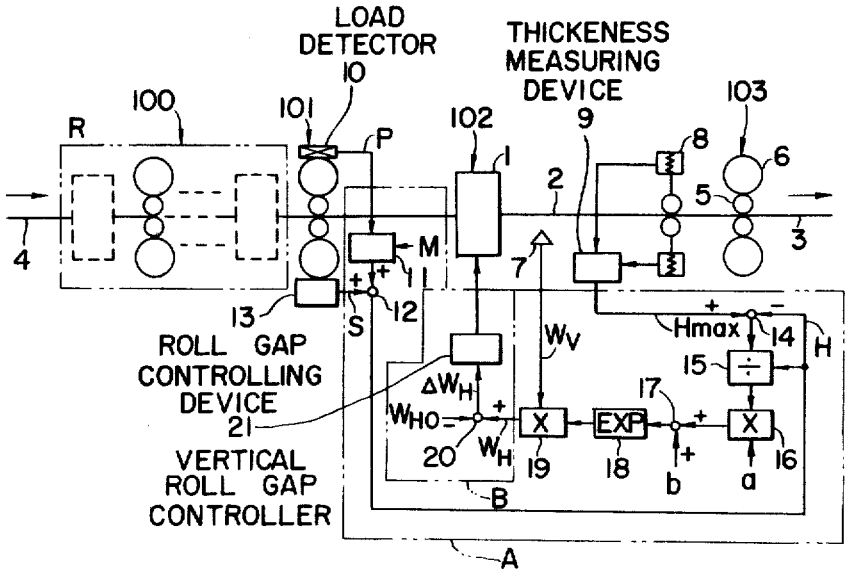
FIGS. 5 through 8 are block diagrams showing embodiments of the invention.

FIG. 5 shows a block diagram of a plate width control system which can be used for performing the control method described above.

The rolling mill for which the plate width control system of the embodiment is provided has a front stage and a succeeding rear stage. The front stage comprises a front roughing stand 100 and the final horizontal roll stand 101. The rear stage comprises a vertical roll stand 102 having a pair of vertical rolls 1 and a horizontal roll stand 103 having a pair of work rolls 5 and a pair of back-up rolls 6.

A reference numeral 4 in FIG. 5 is used to denote the entire plate including the plate 2 at the exit of the vertical roll stand 102 and the plate 3 at the exit of the horizontal roll stand 103.

It is assumed that the plate 4 is put under plate thickness control on said front stage or is subjected to width reduction; that the plate 4 is not subjected to the plate thickness control between the exit of the final horizontal roll stand 101 of the front stage and the exit of the rear stage; that the horizontal roll stand 103 of the rear stage is provided in succession to the vertical roll stand 102; that the gap of horizontal roll stand 103 is controlled in response to the gap of the vertical roll stand of the rear stage; and that the plate 4 is made to have a desired thickness. It should be noted that the width extension caused by the reduction of the thickened portions by the horizontal roll stand 103 by which plate thickness control is effected has no significant difference from the corresponding width extension when plate thickness control is not effected by the horizontal roll stand 103. Thus, nothing other than the amount of the width extension has to be taken into consideration.

A plate width detecting device 7 is disposed at the exit of the vertical roll stand 102 of the rear stage to determine the plate width $W_v$. Provided at the entrance of the horizontal roll stand 103 of the rear stage is a thickened portion thickness detecting device 8, whose output is fed to a thickened portion thickness measuring device 9 for determining the thickness $H_{max}$ of the thickened portions. A load detector 10 is disposed on the final horizontal roll stand 101 of the front stage to determine the rolling load P at the horizontal roll 101. An operational amplifier 11 is used to divide the detected load P by a mill constant M preset in the operational amplifier 11. The quotient is sent to an adder 12.

The adder 12 adds the actual roll gap S outputted from a roll gap controlling device 13 provided for the final horizontal roll stand 101, and provides the sum as the plate thickness H in the equation (3). This value H is then supplied to an adder 14 and also to an operational amplifier 15. Also fed to the adder 14 is the thickness $H_{max}$ of the thickened portions from the measuring device 9. The adder 14 calculates the difference between the thickness $H_{max}$ and the thickness H. The difference $(H_{max}-H)$ calculated by the adder 14 is supplied to the operational amplifier 15. The operational amplifier 15 divides the difference $(H_{max}-H)$ by the plate thickness H to give the ratio X $(=(H_{max}-H)/H)$. The calculated ratio is sent to an operational amplifier 16. The operational amplifier 16 has a coefficient equal to the gradient a of the linear relationship depicted in FIG. 4 in the equation (1), and multiplies the ratio X by the gradient a. The resultant product aX is sent to an adder 17. The adder 17 adds the product aX to an intercept b of the ordinate to give the ratio $^{\epsilon}W_H(=aX+b)$ of the plate width extension in the equation (1). The calculated ratio $^{\epsilon}W_H$ is given to an exponential function generator 18.

The exponential function generator 18 gives an exponential function $\exp(aX+b)=\exp^{\epsilon}W_H$ of the ratio $^{\epsilon}W_H$ of the width extension, i.e., an exponential function $\exp(aX+b)$ $(=\exp^{\epsilon}W_H)$ in the equation 2, (which is equal to the plate width $W_H$ at the exit of the horizontal roll stand of the rear stage divided by the plate width $W_v$ at the exit of the vertical roll stand of the rear stage). The output of the exponential function generator 18 is sent to an operational amplifier 19. The operational amplifier multiplies the ratio $\exp(aX+b)$ of the width extension by the value $W_v$ supplied from the plate thickness detector 7 to give the plate width $W_H$ at the exit of the horizontal roll stand of the rear stage in the equation 2.

An adder 20 subtracts a predetermined target value $W_{Ho}$ of the plate width at the exit of the horizontal roll stand of the rear stage from the plate width $W_H$ supplied from the operational amplifier 19. The result of the subtraction is the deviation $\Delta W_H$ in the equation 4. The deviation $\Delta W_H$ is inputted to a vertical roll gap controller 21. The controller 21 controls the gap of the vertical roll stand 102 of the rear stage in such a manner as to make the deviation $\Delta W_H$ smaller.

Among the members described above, the members 11, 12 and 14 through 19 form a computing unit encircled by a chain line A and the members 20 and 21 form a controlling unit B for controlling the gap of the vertical roll stand of the rear stage.

Figure 6:
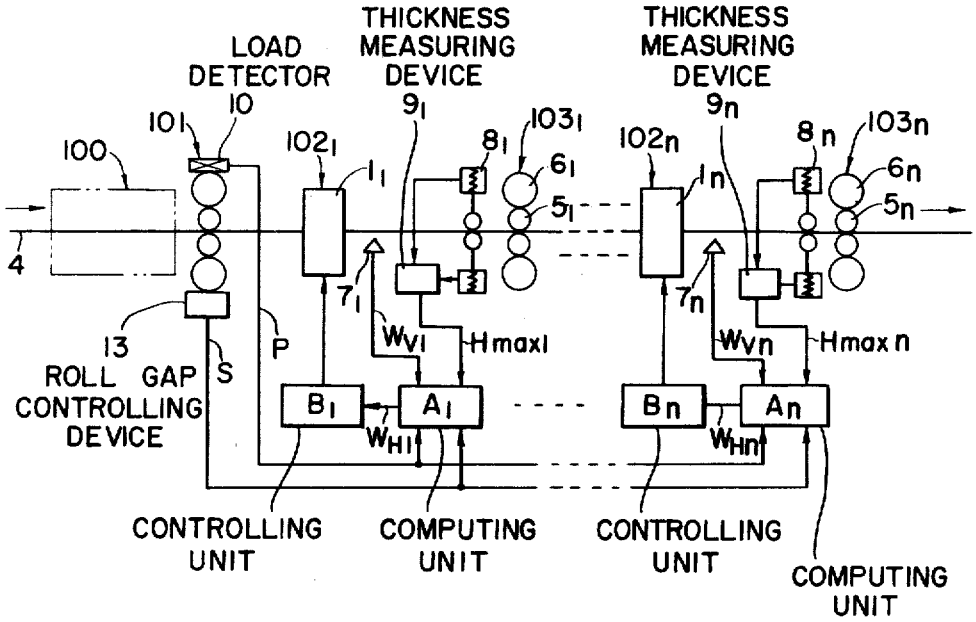

In this manner, the plate width at the exit of the horizontal roll stand of the rear stage can be maintained at the target plate width with minimum errors.

Where there are a plurality of combinations each comprising a vertical roll stand ($102_1$–$102_n$) and a horizontal roll stand ($103_1$–$103_n$) in the roughing mill, as shown in FIG. 6, a plate width control device similar to that shown in FIG. 5 may be provided for each of the combinations. With this arrangement, accuracy of the plate width at the exit of the horizontal roll stand of the rear stage is further improved.

In the embodiment shown in FIG. 6, the plate thickness is not varied during rolling by the rear stage.

Description of the embodiment of FIG. 6 is given in further details. As shown, there are a plurality of vertical roll stands $102_1$–$102_n$ having vertical rolls $1_1$–$1_n$ respectively, and a plurality of horizontal roll stands $103_1$–$103_n$ having work rolls $5_1$–$5_n$ and backup rolls $6_1$–$6_n$, respectively.

Plate width detecting devices $7_1$–$7_n$, and thickened portion thickness detecting devices $8_1$–$8_n$ are respectively provided between the respective vertical roll stands $102_1$–$102_n$ and the respective horizontal roll stands $103_1$–$103_n$. Thickened portion thickness measuring devices $9_1$–$9_n$ are provided in association with the respective thickened portion thickness detecting devices. The plate width detecting devices $7_1$–$7_n$ and the measuring devices $9_1$–$9_n$ produce output signals $W_{v1}$–$W_{vn}$ and $H_{max1}$–$H_{maxn}$ respectively indicating the detected or measured values of the width and the thickness. The output signals are respectively fed to the computing units $A_1$–$A_n$. The output P of the rolling load detector 10 and the output S of the roll gap controller 21 are also fed to the computing units $A_1$–$A_n$. The computing units $A_1$–$A_n$ perform similar operation to the computing unit A shown in FIG. 5 for the associated vertical and horizontal roll stands and produce outputs $W_{H1}$–$W_{Hn}$, which are fed to the respective vertical roll gap controllers $B_1$–$B_n$. The controllers $B_1$–$B_n$ respectively control the gaps of the vertical roll stands $102_1$–$102_n$ in such a manner as to make the deviations $\Delta W_{H1}$–$\Delta W_{Hn}$ of the plate widths smaller. Providing a plate width detecting device, a thickened portion thickness detecting device, a thickened portion thickness measuring device, a computing unit and a controller for each combination of a vertical roll stand and a succeeding horizontal roll stand will improve accuracy of the width of the plate at the exit of the rear stage.

If, as opposed to the embodiment shown in FIG. 6, it is desired to vary the plate thickness during pass through the horizontal roll stands of the rear stage, reduction load and roll gap of the horizontal roll stand of each combination are detected and used, in place of the reduction load and the roll gap of the final horizontal roll stand of the front stage, in the calculation by the computing unit ($A_2$–$A_n$) provided for the vertical roll stand of the same combination, i.e., the vertical roll stand positioned next to each horizontal roll stand.

Figure 7:
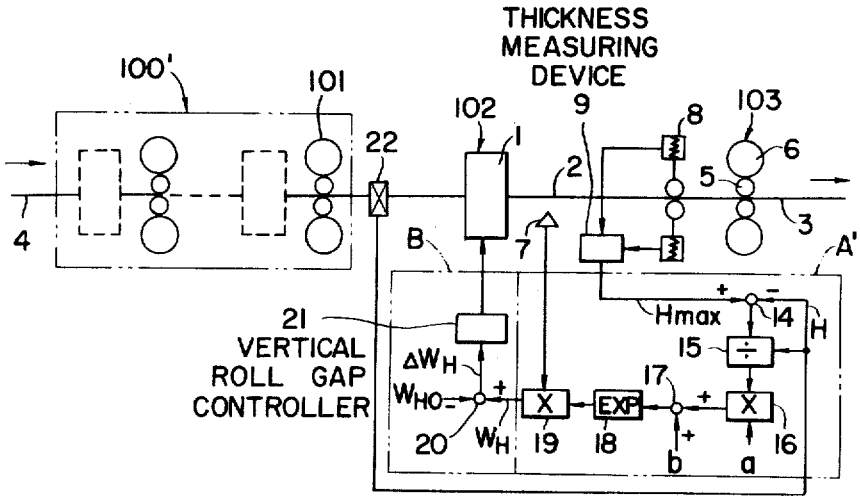

FIG. 7 shows another embodiment of the plate width control system according to the present invention.

The plate width control system of this embodiment has a plate thickness detector 22 provided between the final horizontal roll stand 101 of the front stage 100' and the vertical roll stand 102 of the rear stage in place of the rolling load detector 10 and the roll gap controller 13 for the final horizontal roll stand of the front stage.

In the embodiment shown in FIG. 7, the plate thickness at the exit of the front stage 100' is not calculated from the roll gap S, the rolling load P and the mill constant M, but is directly detected by a plate thickness detector 22. The rest of control operation is similar to that of the embodiment shown in FIG. 5.

The embodiment shown in FIG. 7 has the advantage of a simpler control circuit compared with the embodiment shown in FIG. 5.

Figure 8:
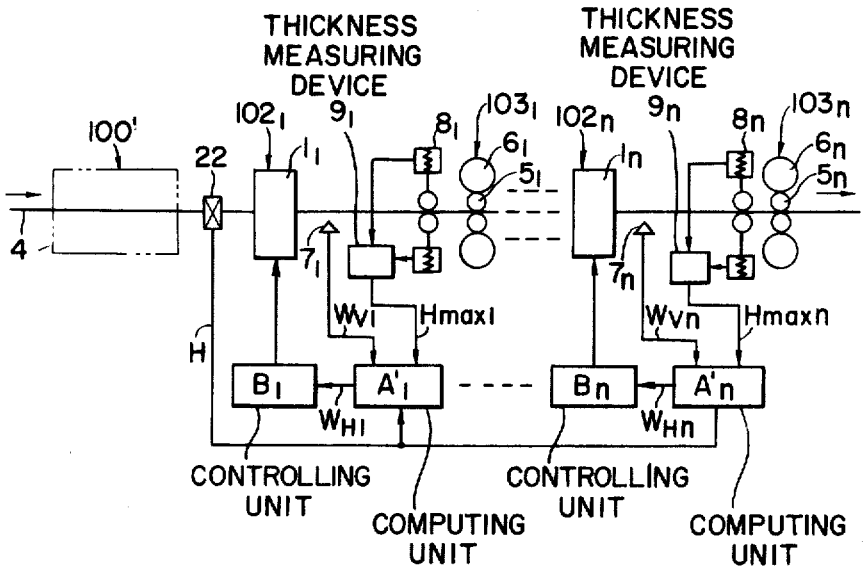

FIG. 8 shows a modification of the embodiment shown in FIG. 7. The control system shown in FIG. 8 is adapted to a rolling mill including a rear stage having a plurality of combinations of a vertical roll stand ($102_1$–$102_n$) and a horizontal roll stand ($103_1$–$103_n$). A plate width detector ($7_1$–$7_n$), a maximum thickness detecting device ($8_1$–$8_n$), a maximum tnickness measuring device ($9_1$–$9_n$), a computing unit ($A'_1$–$A'_n$) and a vertical roll gap control unit ($B_1$–$B_2$) are provided for each of the combinations. This arrangement also improves accuracy of the width of the plate at the exit of the roll stand.

If, as opposed to the embodiment shown in FIG. 8, it is desired to vary the plate thickness during pass through the horizontal roll stands of the rear stage, plate thickness at the entrance of the vertical roll stand of each combination is detected and used, in place of the plate thickness at the entrance of the rear stage, in the calculation by the computing unit ($A'_2$–$A'_n$) provided for the respective vertical roll stand of each combination.

The thickened portion thickness detecting device (8, $8_1$–$8_n$) for detecting the thickness of the thickened portion will be explained. The detector shown in FIGS. 5–8 is a maximum plate thickness detector which has small sized horizontal rolls placed on a metal plate to be rolled 4 and movable thickness-wise. The mechanical displacement is converted by the measuring device (9, $9_1$–$9_n$) into an electrical signal proportional to the mechanical movement and hence to the maximum thickness of the plate 4. The electrical signal is inputted to the computing unit.

The mechanical type maximum thickness detector may be found insufficiently accurate in some applications. Then, a maximum thickness detecting device which does not rely on mechanical contact and hence on mechanical movement may be used. An example of such a maximum thickness detecting device is an X-ray plate thickness detecting device.

The plate thickness detecting device of the above-mentioned type can be made to serve also as a plate thickness detector (7, $7_1$–$7_n$).

What is claimed is:

1. A method for controlling a plate width in a hot rolling mill having a front stage including a horizontal roll stand; and a rear stage following said front stage and including a vertical roll stand and a horizontal roll stand, said method comprising the steps of: determining the thickness of a thickened portion of the plate thickened as a result of rolling by the vertical roll stand of the rear stage and the plate thickness at the entrance of the vertical roll stand of the rear stage; calculating the ratio of the thickness of the thickened portion to the plate thickness at the entrance of the rear stage; determining the plate width at the exit of the vertical roll stand; calculating, the plate width at the exit of the horizontal roll stand of the rear stage, based at least in part on said calculated ratio of the thicknesses of the plate and said determined plate width; and controlling the roll gap of the vertical roll stand of the rear stage to bring the plate width at the exit of the horizontal roll stand of the rear stage closer to a target value.

2. A method according to claim 1, wherein the rear stage includes a plurality of combinations each comprising a vertical roll stand and a horizontal roll stand, and wherein the plate thickness at the entrance of the vertical roll stand of the first one of said combinations, is determined, the thickness of the thickened portion of the plate and the width of the plate at the exit of the vertical roll stand of each of said combinations are determined, the plate thickness at the exit of the horizontal roll stand of each of said combinations is calculated based on the plate width at the exit of the vertical roll stand of the same one of said combinations and on the ratio of the thickness of the thickened portion at the exit of the vertical roll stand of the same one of said combinations to the plate thickness at the entrance of the vertical roll stand of the first one of said combinations, and the gap of the vertical roll stand of each of said combinations is controlled to bring the calculated plate width at the exit of the horizontal roll stand of the same one of said combinations closer to a target value.

3. A method according to claim 1, wherein the rear stage includes a plurality of combinations each comprising a vertical roll stand and a horizontal roll stand, and wherein the plate thickness at the entrance of the vertical roll stand of each of said combinations is determined, the thickness of the thickened portion of the plate and the width of the plate at the exit of the vertical roll stand of each of said combinations are determined, the plate thickness at the exit of the horizontal roll stand of each of said combinations is calculated based on the plate width at the exit of the vertical roll stand of the same one of said combinations and on the ratio of the thickness of the thickened portion at the exit of the vertical roll stand of the same one of said combinations to the plate thickness at the entrance of the vertical roll stand of the same one of said combinations, and the gap of the vertical roll stand of each of said combinations is controlled to bring the calculated plate width at the exit of the horizontal roll stand of the same one of said combinations closer to a target value.

4. A method according to claim 1, 2 or 3, wherein determination of the thickness of the plate at the entrance of the vertical roll stand is achieved by calculation from the roll gap, the rolling load and the mill constant of the horizontal roll stand in front of the vertical roll stand.

5. A method according to claim 1, 2 or 3, wherein determination of the thickness of the plate at the entrance of the vertical roll stand is achieved by direct measurement.

6. A method according to claim 1, wherein, when the thickness of the thickened portion of the plate is denoted by $H_{max}$, the plate thickness at the entrance of the vertical roll stand of the rear stage is denoted by H, and the plate width at the exit of the vertical roll stand is denoted by $W_V$, the calculation of the plate width $W_H$ at the exit of the horizontal roll stand of the rear stage is in accordance with the equation:

$$W_H = W_V \exp\left(a \frac{H_{max-H}}{H} + b\right)$$

wherein a and b represent constants which can be adjusted or modified through learning control.

7. A method according to claim 6, wherein the rear stage includes a plurality of combinations each comprising a vertical roll stand and a horizontal roll stand, and wherein the plate thickness at the entrance of the vertical roll stand of the first one of said combinations is determined, the thickness of the thickened portion of the plate and the width of the plate at the exit of the vertical roll stand of each of said combinations are determined, the plate thickness at the exit of the horizontal roll stand of each of said combinations is calculated based on the plate width at the exit of the vertical roll stand of the same one of said combinations and on the ratio of the thickness of the thickened portion at the exit of the vertical roll stand of the same one of said combinations to the plate thickness at the entrance of the vertical roll stand of the first one of said combinations, and the gap of the vertical roll stand of each of said combinations is controlled to bring the calculated plate width at the exit of the horizontal roll stand of the same one of said combinations closer to a target value.

8. A method according to claim 6, wherein the rear stage includes a plurality of combinations each comprising a vertical roll stand and a horizontal roll stand, and wherein the plate thickness at the entrance of the vertical roll stand of each of said combinations is determined, and the thickness of the thickened portion of the plate and the width of the plate at the exit of the vertical roll stand of each of said combinations are determined, the plate thickness at the exit of the horizontal roll stand of each of said combinations is calculated based on the plate width at the exit of the vertical roll stand of the same one of said combinations and on the ratio of the thickness of the thickened portion at the exit of the vertical roll stand of the same one of said combinations to the plate thickness at the entrance of the vertical roll stand of the same one of said combinations, and the gap of the vertical roll stand of each of said combinations is controlled to bring the calculated plate width at the exit of the horizontal roll stand of the same one of said combinations closer to a target value.

9. A method according to claims 6, 7 or 8, wherein determination of the thickness of the plate at the entrance of the vertical roll stand is achieved by calculation from the roll gap, the rolling load and the mill constant of the horizontal roll stand in front of the vertical roll stand.

10. A method according to claims 6, 7 or 8, wherein-determination of the thickness of the plate at the entrance of the vertical roll stand is achieved by direct measurement.

11. A plate width control system for a hot rolling mill having a front stage including a horizontal roll stand and a rear stage following the front stage and including a vertical roll stand and a horizontal roll stand, comprising thickened portion thickness determining means for determining the thickness of a thickened portion of a plate thickened as a result of rolling by the vertical roll stand of the rear stage; thickness determining means for determining the plate thickness at the entrance of the vertical roll stand of the rear stage; ratio determining means for determining the ratio of the thickness of the thickened portion to the plate thickness at the entrance of the vertical roll stand based on the output from said thickened portion thickness determining means and the output from said thickness determining means; first width determining means for determining the plate width at the exit of the vertical roll stand of the rear stage; second width determining means for determining the plate width at the exit of the horizontal roll stand of the rear stage based on the output from said ratio determining means and the output from said first width determining means; roll gap controlling means for calculating the deviation of the plate width at the exit of the horizontal roll stand of the rear stage based on the output from said second width determining means and a target value; and controlling the roll gap of the vertical roll stand of the rear stage to make the deviation smaller.

12. A system according to claim 11, where said plate thickness determining means is adapted to calculate the thickness of the plate at the entrance of the vertical roll stand, based on the roll gap, the rolling load and the mill constant of the horizontal roll stand in front of the vertical roll stand.

13. A system according to claim 11, wherein said plate thickness determining means comprises a plate thickness detector for directly detecting the thickness of the plate at the entrance of the vertical roll stand.

* * * * *